US009706330B2

(12) United States Patent
Tikkanen et al.

(10) Patent No.: US 9,706,330 B2
(45) Date of Patent: Jul. 11, 2017

(54) LOUDSPEAKER CONTROL

(71) Applicant: Genelec Oy, Iisalmi (FI)

(72) Inventors: Jussi Tikkanen, Iisalmi (FI); Juha Urhonen, Iisalmi (FI); Aki Mäkivirta, Lapinlahti (FI); William Eggleston, Wayland, MA (US); Pekka Moilanen, Iisalmi (FI); Kari Pöyhönen, Leppäkaarre (FI)

(73) Assignee: Genelec Oy, Iisalmi (FI)

( * ) Notice: Subject to any disclaimer, the term of this patent is extended or adjusted under 35 U.S.C. 154(b) by 94 days.

(21) Appl. No.: 14/483,188

(22) Filed: Sep. 11, 2014

(65) Prior Publication Data

US 2016/0080887 A1 Mar. 17, 2016

(51) Int. Cl.

| | |
|---|---|
| ***H04R 5/02*** | (2006.01) |
| ***H04S 7/00*** | (2006.01) |
| ***H04R 5/04*** | (2006.01) |
| *H04R 3/04* | (2006.01) |

(52) U.S. Cl.

CPC ..... *H04S 7/40* (2013.01); *H04R 5/04* (2013.01); *H04S 7/301* (2013.01); *H04R 3/04* (2013.01); *H04S 2400/13* (2013.01)

(58) Field of Classification Search

CPC ..... H04R 5/02; H04R 2420/07; H04S 7/308; H04S 3/00

USPC ..... 381/56–58, 303, 300, 17, 306, 307

See application file for complete search history.

(56) References Cited

U.S. PATENT DOCUMENTS

| | | | | |
|---|---|---|---|---|
| 2014/0119581 | A1* | 5/2014 | Tsingos | H04S 3/008 381/300 |
| 2015/0098596 | A1* | 4/2015 | Noah | H04S 7/301 381/303 |
| 2015/0208187 | A1* | 7/2015 | Carlsson | H04R 3/12 381/79 |
| 2015/0215722 | A1* | 7/2015 | Milne | H04S 7/305 381/300 |
| 2015/0256957 | A1* | 9/2015 | Kim | H04R 3/12 381/303 |

* cited by examiner

*Primary Examiner* — Vivian Chin
*Assistant Examiner* — Ammar Hamid
(74) *Attorney, Agent, or Firm* — Seppo Laine Oy

(57) ABSTRACT

According to an example aspect of the present invention, an apparatus is provided comprising at least one processing core and at least one memory including computer program code, the at least one memory and the computer program code being configured to, with the at least one processing core, cause the apparatus at least to present a graphical user interface comprising a spatial representation and at least one element, the element being associated with at least one specific physical loudspeaker, and receive input concerning moving of the at least one element within the spatial representation, activate a sensory signal in a physical loudspeaker associated with the first element, determine a location in the spatial representation where the first element is moved to, and based at least in part on the determined location, assign a name to at least the first element and the physical loudspeaker associated with the first element.

31 Claims, 5 Drawing Sheets

LOUDSPEAKER CONTROL

FIELD OF INVENTION

The present invention relates to facilitating control of, and/or controlling, at least one loudspeaker.

BACKGROUND OF INVENTION

Music playback can be accomplished using loudspeakers. Loudspeakers can be designed as general purpose loudspeakers or specialized loudspeakers, wherein specialized loudspeakers may be optimized to produce sound in a selected frequency range. For example, subwoofer loudspeakers are optimized to emit low-pitched audio frequencies known as bass.

An audio recording may comprise more than one audio channel, for example a stereo recording comprises two channels, left and right. Playing back a stereo recording thus advantageously employs at least two loudspeakers to replicate the left and right channels to create a stereo listening experience for a listener. More advanced audio recordings may comprise further channels. For example, a five-channel surround recording may comprise a left channel, a centre channel, a right channel, a left surround channel and a right surround channel. To create the intended surround listening experience, these channels would optimally be reproduced by loudspeakers positioned in a correct way with respect to the listener. A typical agreement of loudspeaker placement is to place loudspeakers at equal acoustic delay and to equal level at the listening position, and into certain angles and heights relative to the listener. A typical interpretation of the equal delay is equal distance, valid when all loudspeakers have equal internal latency for passing the electronic input signal to acoustic output.

When controlling a multi-loudspeaker system, loudspeakers may be arranged to be controllable using electrical signals exchanged between the loudspeakers and a control device, such as for example a computer. A set of communications connections may interconnect the control device and the loudspeakers. From the point of view of the control device, loudspeakers may be assigned identifiers to enable communication with a specific loudspeaker, to pass information relating individually to specific loudspeakers. For example, a user may employ manual electric switches in the loudspeakers to configure each loudspeaker with an identifier that is unique within the multi-loudspeaker system in question. An example of a manual electric switch is a dip switch.

Subsequent to a loudspeaker being assigned an identifier, manually by the user, the control device may inquire, via a communication connection arranged between the control device and the loudspeaker, the identifier from the loudspeaker. Thus the user may assign identifiers to loudspeakers in the multi-loudspeaker system to facilitate individual control of loudspeakers comprised therein.

SUMMARY OF THE INVENTION

According to an example aspect of the present invention, an apparatus is provided comprising at least one processing core and at least one memory including computer program code, the at least one memory and the computer program code being configured to, with the at least one processing core, cause the apparatus at least to present a graphical user interface comprising a spatial representation and at least one element, the element being associated with at least one specific physical loudspeaker, and receive input concerning moving of the at least one element within the spatial representation, activate a sensory signal in a physical loudspeaker associated with the first element, determine a location in the spatial representation where the first element is moved to, and based at least in part on the determined location, assign a name to at least the first element and the physical loudspeaker associated with the first element.

Various embodiments of the first aspect may comprise at least one feature from the following bulleted list:

- the at least one memory and the computer program code are configured to, with the at least one processing core, cause the apparatus to, based at least in part on the determined location, assign an audio channel to the physical loudspeaker associated with the first element
- the sensory signal comprises at least one of a sound or a light signal
- the spatial representation models, at least in part, a system layout of a loudspeaker system
- the at least one element comprises at least two elements, the at least two elements being associated with physical loudspeakers of different types
- the different types comprise a monitor loudspeaker and a subwoofer
- the at least one memory and the computer program code are configured to, with the at least one processing core, cause the apparatus to assign the name based at least in part on whether the determined location is in a central part, a left-hand-side part or a right-hand-side part of the spatial representation
- the graphical user interface comprises a functionality configured to, when activated, trigger a calibration procedure
- the calibration procedure comprises calibration of at least one of sound colour, timing and volume
- the graphical user interface is configured to convey information relating to a status of at least one physical loudspeaker associated with an element comprised in the graphical user interface
- the at least one memory and the computer program code are configured to, with the at least one processing core, cause the apparatus to assign the name based at least in part on a type of physical loudspeaker associated with the first element
- the graphical user interface comprises at least two spatial representations, each of the at least two spatial representations being associated with a vertical level of a room
- the at least one memory and the computer program code are configured to, with the at least one processing core, cause the apparatus to conceal at least one spatial representation that is not in use from view, while a user interacts with another spatial representation
- the at least one memory and the computer program code are configured to, with the at least one processing core, cause the apparatus to select, based at least in part on the determined location, a digital audio subframe for the physical loudspeaker associated with the first element
- the at least one memory and the computer program code are configured to, with the at least one processing core, cause the apparatus to associate one monitor loudspeaker with one subwoofer, the monitor loudspeaker and the subwoofer each being associated with exactly one of the at least two elements
- the at least one memory and the computer program code are configured to, with the at least one processing core, cause the apparatus to cause calibration of a phase of the subwoofer associated with the monitor loudspeaker, with the monitor loudspeaker the calibration comprises using at least one of a maximal cancellation method or a Fourier analysis method the at least one memory and the computer program code are configured to, with the at least one processing core, cause the apparatus to determine an impulse response of a room associated with the spatial representation, and to determine, based at least in part on the impulse response, equalization information concerning the room the graphical user interface comprises functionality configured to, when activated, enable a user to at least one of view and modify equalization information concerning a specific physical loudspeaker.

According to a second aspect of the present invention, there is provided a method, comprising presenting, in an apparatus, a graphical user interface comprising a spatial representation and at least one element, each of the at least element being associated with a specific physical loudspeaker, receiving an input concerning moving a first element comprised in the at least one element within the spatial representation, activating a sensory signal in a physical loudspeaker associated with the first element, determining a location in the spatial representation where the first element is moved to, and assigning, based at least in part on the determined location, a name to at least one of the first element and the physical loudspeaker associated with the first element.

Various embodiments of the second aspect may comprise at least one feature corresponding to a feature from the preceding bulleted list laid out in connection with the first aspect.

According to a third aspect of the present invention, there is provided a non-transitory computer readable medium having stored thereon a set of computer readable instructions that, when executed by at least one processor, cause an apparatus to at least present, in an apparatus, a graphical user interface comprising a spatial representation and at least one element, each of the at least element being associated with a specific physical loudspeaker, receive an input concerning moving a first element comprised in the at least one element within the spatial representation, activate a sensory signal in a physical loudspeaker associated with the first element, determine a location in the spatial representation where the first element is moved to and based at least in part on the determined location, and assign a name to at least one of the first element and the physical loudspeaker associated with the first element.

According to a fourth aspect of the present invention, there is provided an apparatus comprising means for presenting, a graphical user interface comprising a spatial representation and at least one element, each of the at least element being associated with a specific physical loudspeaker, means for receiving an input concerning moving a first element comprised in the at least one element within the spatial representation, means for activating a sensory signal in a physical loudspeaker associated with the first element, means for determining a location in the spatial representation where the first element is moved to and based at least in part on the determined location, and means for assigning a name to at least one of the first element and the physical loudspeaker associated with the first element

INDUSTRIAL APPLICABILITY

At least some embodiments of the present invention find industrial application in enabling and/or controlling loudspeakers.

DETAILED DESCRIPTION OF EXAMPLE EMBODIMENTS

Figure 1:
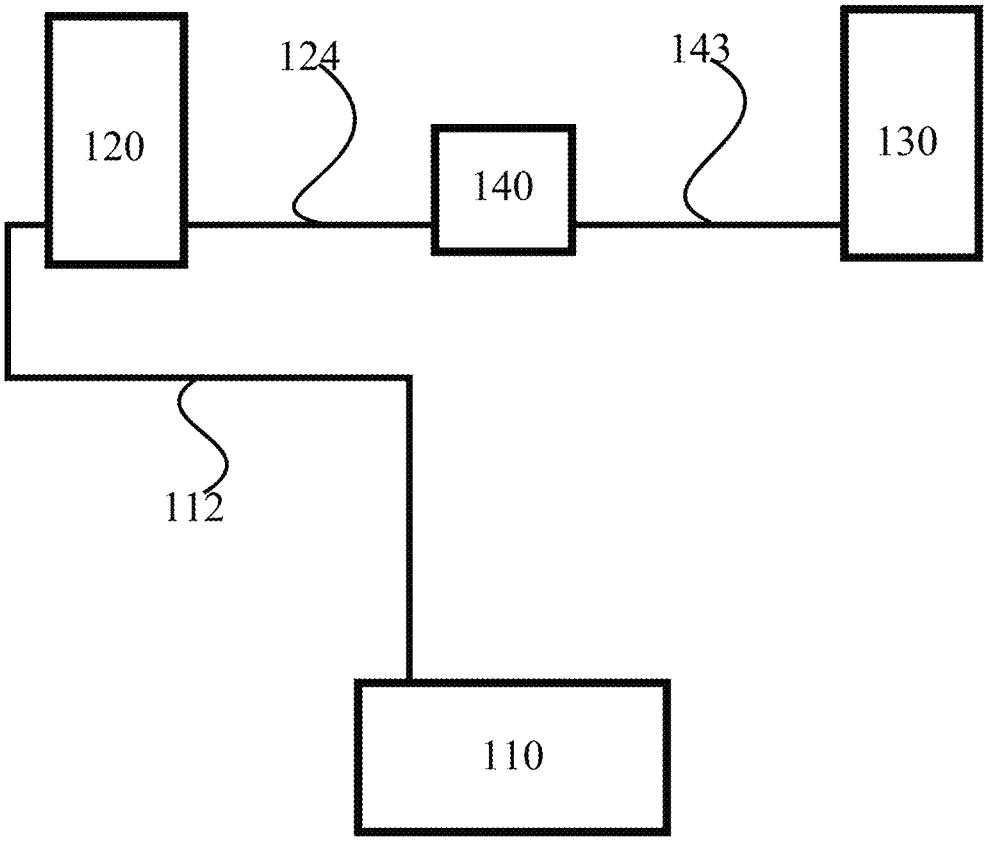
FIG. 1 illustrates an example system capable of supporting at least some embodiments of the present invention.

FIG. 1 illustrates an example system capable of supporting at least some embodiments of the present invention. FIG. 1 illustrates control device 110, which may comprise a control station, a computer, such as a laptop, or other device configured to enable controlling of the multi-loudspeaker system. The multi-loudspeaker system of FIG. 1 comprises left channel loudspeaker 120, right channel loudspeaker 130 and centre channel loudspeaker 140. The centre channel loudspeaker may comprise a woofer element, for example.

Control device 110 may transmit electrical signals to the loudspeakers via a communications network comprising connection 112 arranged between control device 110 and left channel loudspeaker 120, connection 124 arranged between left channel loudspeaker 120 and centre channel loudspeaker 140, and connection 143 arranged between centre channel loudspeaker 140 and right channel loudspeaker 130.

In use, to transmit a control message to right channel loudspeaker 130, control device 110 may compile a message, for example in a frame, that comprises as a recipient address an identifier of right channel loudspeaker 130. Control device 110 may then transmit the message, via connection 112, to all loudspeakers being connected to the control network logically and electronically in parallel fashion. Left channel loudspeaker 120, being in receipt of the message, may inspect the recipient field in the message to determine whether the recipient field comprises an identifier of left channel loudspeaker 120. In this case this is not the case, the left channel may ignore the message, and the loudspeaker that recognizes the message as addressed to it can read and act based on the message. If the network is implemented such that it requires the messages to be passed between loudspeakers, the left channel loudspeaker 120 may be configured to forward the message to centre channel loudspeaker 140, via connection 124. In the latter case, the centre channel loudspeaker, realizing that the recipient field does not comprise an identifier of centre channel loudspeaker 140, forwards the message to right channel loudspeaker 130 via connection 143. Right channel loudspeaker 130 in turn determines that the recipient field of the message comprises an identifier of right channel loudspeaker 130, and consequently that the message is intended for right channel loudspeaker 130. If appropriate, right channel loudspeaker 130 may compile and transmit a response to control unit 110. In the response, right channel loudspeaker 130 may place an identifier of control unit 110 in the recipient field of the message, so that the message will be routed along connections 143, 124 and 112 to control unit 110.

To enable messaging in the illustrated system, a user may manually configure identifier of the loudspeakers by, for example, configuring a dip switch in each of the loudspeakers, and then inputting the identifiers to control device 110. A drawback in such manual configuring is that it is slow and prone to error, as it is not guaranteed the user correctly configured for each loudspeaker the same code in the loudspeaker and in control unit 110. A further opportunity for error is where the user accidentally configured more than one loudspeaker with the same identifier, which would confuse the messaging.

Optionally to configuring an identifier manually in each loudspeaker, loudspeakers may be pre-configured at manufacture with a unique identifier, which may comprise a serial number, for example. When a user has connected the loudspeakers to control unit 110, he may then be presented with a list of identifiers of loudspeakers comprised in the multi-loudspeaker system. The user may then associate, using a user interface of control device 110, each identifier with a loudspeaker. For example, the user may read the identifier printed behind a loudspeaker and then indicate to control device 110 that that identifier is an identifier of a left channel loudspeaker, for example.

Alternatively, the user interface of control device 110 may allow the user to cause a loudspeaker to emit a sensory signal such as a noise or flash of light, to enable association in control device 110 of identifiers to loudspeakers in the system. For example, control device 110 may transmit a message to loudspeakers in the multi-loudspeaker system, a recipient field of the message comprising an identifier the user selects, to cause that loudspeaker to emit a sensory signal. The user may then tell control device 110 which loudspeaker in the system emitted the sensory signal, for example the left channel loudspeaker. Prior to presenting the user a list of identifiers of loudspeakers connected to control device 110, loudspeakers connected to control device 110 may signal to control device 110 to inform control device 110 of their identifiers.

Although illustrated in FIG. 1 as a set of connections 112, 124 and 143, the communication connections between control device 110 and loudspeakers may take other forms without departing from the scope of the invention. For example, there may be a separate wire-line connection from control device 110 to each of the loudspeakers comprised in the multi-loudspeaker system. In some embodiments, control device 110 and the loudspeakers are interconnected by a wireless connection, such as for example WLAN, Bluetooth or a variant thereof. In some embodiments, control device 110 has a wire-line connection to at least one of the loudspeakers comprised in the multi-loudspeaker system for feeding audio data for playback, and another connection, which may be wireless, to control aspects of the at least one loudspeaker. Examples of controllable aspects, in general, comprise error management, installing filters to be applied to audio signals and controlling loudspeakers to switch between an active and an inactive state.

Figure 2:
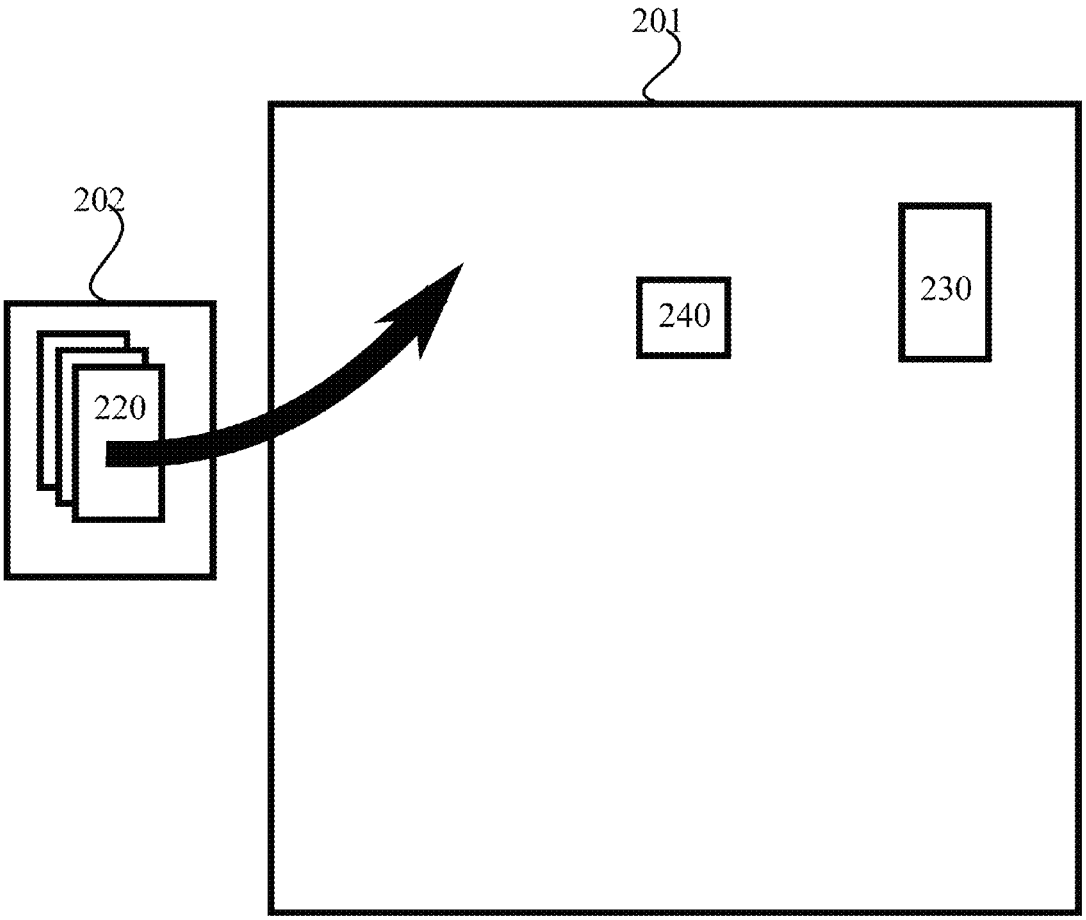
FIG. 2 illustrates an example use case in accordance with at least some embodiments of the present invention.

FIG. 2 illustrates an example use case in accordance with at least some embodiments of the present invention. In FIG. 2 is illustrated a user interface of control device 110 of FIG. 1. Comprises in the user interface are layout map 201 and stack 202. Displayed in layout map 201 are elements 240 and 230, wherein element 240 is associated with the centre channel loudspeaker 140 of FIG. 1 and element 230 is associated with right channel loudspeaker 130 of FIG. 1. In the illustrated snapshot of the user interface, the user has already associated element 240 with the centre channel loudspeaker and element 230 with the right channel loudspeaker.

Next, the user will use the user interface to assign element 220 a name. Prior to the user using the user interface, each loudspeaker in the system will have provided to control device 110 its unique identifier, wherein by unique it is meant unique within the multi-loudspeaker system. Such identifiers may be assigned during manufacture or be at least in part assigned by control device 110. Once control device 110 is in possession of all identifiers, it generates exactly one element of the user interface corresponding to each identifier. Generated elements are places in stack 202, where they may be visually represented to the user.

To assign element 220 a name, the user may select element 220 in the stack, for example by moving a cursor on element 220 and activating a physical button. Responsively, control device 110 may be configured to signal to the loudspeaker associated with element 220, based on the identifier, to cause the loudspeaker to emit a sensory signal. A sensory signal may comprise an audible or visual signal, such as a flashing light. Signaling to the loudspeaker to cause it to emit the sensory signal comprises activating, by control device 110, the sensory signal in the loudspeaker.

The user will determine which of the physical loudspeakers in the room is emitting the sensory signal, and cause element 220 to be placed in a position on layout map 201 that corresponds to a place in the room where the physical loudspeaker is. In the illustrated example, the loudspeakers are arranged on the floor as illustrated in FIG. 1 and element 220 corresponds to left channel loudspeaker 120, so the user will place element 220 to the left-hand-side front part of layout map 201. This is illustrated in FIG. 2 with a black arrow. The user may place element 220 in the desired position, for example, by clicking on element 220 and moving, using a mouse or other pointer device, element 220 to the desired location before releasing the click. This may correspond to a dragging user interface interaction, for example.

Once the user has placed element 220 in the desired location, control device 110 may responsively assign a name to the element, based at least in part on the location. For example, in the example of FIG. 2, the name may be "Left Front", or "Left 8320A" to indicate also a type of loudspeaker. The loudspeaker type may be received in control device 110 directly from the loudspeaker, without user involvement. Layout map 201 may to enable this be predivided into sections for naming purposes. The borders between such sections may be visually displayed to the user in the user interface. Based on the location, in addition to or alternatively to assigning a name an audio channel may be assigned to the physical loudspeaker associated with element 220. For example, in the case illustrated in FIG. 2 the left front audio channel may be assigned to the physical loudspeaker that has the identifier that element 220 is associated with. Therefore, each element in the user interface may be associated with a physical loudspeaker and an identifier of the physical loudspeaker concerned. In general, the assigned name may be assigned at least in part based on the location where the user moves the user interface element to, and/or the name may be assigned at least in part based on a type of the loudspeaker or subwoofer associated with the element.

In general, a user interface element may be associated with one and only one physical loudspeaker. In some embodiments, control device 110 is configured to assign an audio channel based at least in part on the determined location, but not to assign a name. In other words, control device 110 may be configured to assign, based at least in part on the determined location, at least one of a name and an audio channel.

The user may place each of the elements in stack 202 to locations in layout map 201, until the stack is empty and all applicable loudspeakers in the multi-loudspeaker system have been placed on the layout map 201. The elements may initially be in stack 202 in any order, for example an order in which they are discovered by control device 110. At that time, all applicable loudspeakers in the multi-loudspeaker system may be assigned names and/or audio channels. Some multi-loudspeaker systems may comprise also loudspeakers that cannot be assigned names and/or audio channels using the method described herein. Such loudspeakers may be configured and controlled by the user in other ways.

In some embodiments, the user interface comprises more than one layout map, each layout map corresponding to a layer in the room. For example, one layout map may correspond to the floor and another layout map may correspond to the ceiling. In the layout map corresponding to the ceiling, elements moved to locations in this layout map may be associated with physical loudspeakers attached to the ceiling of the room. A layout map as described herein may comprise a spatial representation of a room, or a layer in a room, such as for example the floor of a room or a ceiling of a room. In some embodiments, at least one layout map currently not in use or not interacted with may be minimized in a user interface view.

The method described herein provides a reliable and fast way to assign named and audio channels to even a large number of loudspeakers, while eliminating many potential sources of error in the configuration process.

Elements in the user interface may comprise interaction possibilities allowing a user to interact with a physical loudspeaker associated with the element. For example, configuring the physical loudspeaker may be accomplished, at least in part, via interacting with an element in the user interface. Equalization user interface elements for each physical loudspeaker may be accessible via the associated elements. Calibration of physical loudspeakers may be performed by interacting via the associated elements. Calibration may involve setting a colour, time offset and level of audio, for example. Bass settings may be modified by interacting via a user interface element associated with a bass loudspeaker.

Information concerning internal states of loudspeakers and woofers may be seen by interacting via the associated elements. For example, an error condition may be signalled to the user by changing a colour of a user interface element associated with a physical loudspeaker that develops an error condition, for example to red. As another example, an operational condition may be signalled by changing the colour of a user interface element to another colour, such as blue or green. In case control device 110 cannot receive responses to messages sent to a physical loudspeaker, an associated user interface element may be greyed out or otherwise modified to indicate this.

In some embodiments, control device 110 polls, for example periodically, loudspeakers and subwoofers comprised in the multi-loudspeaker system. The user may configure what data he prefers to see displayed in the user interface of control device 110. Possible data that may be included comprises at least one of the following:

- no status information, only the element associated with each loudspeaker being visible
- loudspeaker name
- a signal level arriving at, and departing from, each loudspeaker and subwoofer
- a selected audio channel
- bass control state, for example on/off and frequency settings
- internal temperature, such as the temperature(s) of electronics and/or drivers and/or their parts
- signal clip occurrence and indicator status thereof
- length of time the loudspeaker or subwoofer has been on
- voltage present in at least section of a loudspeaker or subwoofer
- current present in at least section of a loudspeaker or subwoofer
- driver resistances In addition to, or alternatively, to, assigning an audio channel to a physical loudspeaker based on the location where the user moves an associated element to, reception of a subframe may be assigned in the physical loudspeaker, based on the location. A subframe may be comprised in a digital audio transmission stream, for example of the AES/EBU (AES-3) formatted data stream, enabling one data stream to carry several audio channels encoded into the stream. A user may modify the assignment of the subframe, or assign a subframe, to a physical loudspeaker by interacting with the associated user interface element. Other possibilities include enabling a user to group physical loudspeakers together into groups by interacting with their associated user interface elements, and/or enabling control of bass management for physical loudspeakers or groups of physical loudspeakers.

Figure 3:
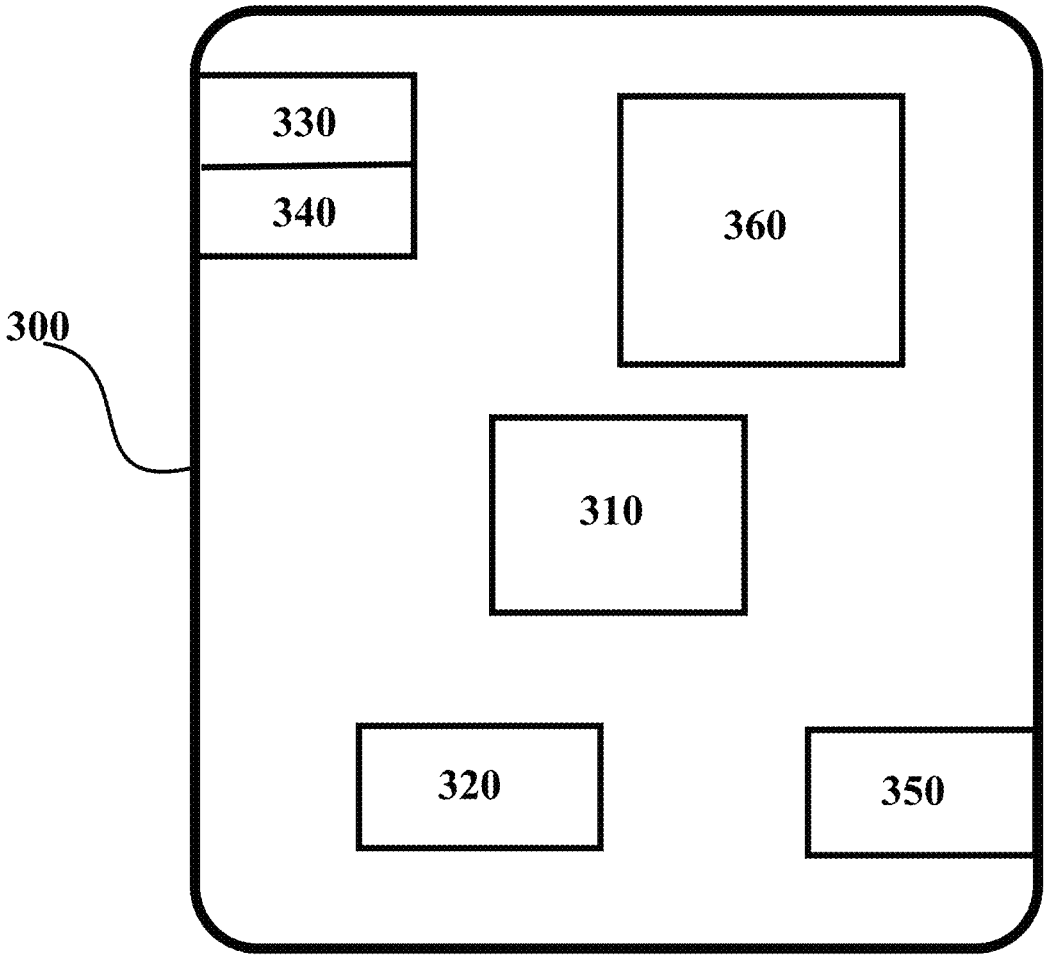
FIG. 3 illustrates an example apparatus capable of supporting at least some embodiments of the present invention.

FIG. 3 illustrates an example apparatus capable of supporting at least some embodiments of the present invention. Illustrated is device 300, which may comprise, for example, control device 110 of FIG. 1. Comprised in device 300 is processor 310, which may comprise, for example, a single-core or multi-core processor wherein a single-core processor comprises one processing core and a multi-core processor comprises more than one processing core. Processor 310 may comprise a Qualcomm Snapdragon 800 processor, for example. Processor 310 may comprise more than one processor. A processing core may comprise, for example, a Cortex-A8 processing core manufactured by Intel Corporation or a Brisbane processing core produced by Advanced Micro Devices Corporation. Processor 310 may comprise at least one application-specific integrated circuit, ASIC. Processor 310 may comprise at least one field-programmable gate array, FPGA. Processor 310 may be means for performing method steps in device 300. Processor 310 may be configured, at least in part by computer instructions, to perform actions.

Device 300 may comprise memory 320. Memory 320 may comprise random-access memory and/or permanent memory. Memory 320 may comprise at least one RAM chip. Memory 320 may comprise magnetic, optical and/or holographic memory, for example. Memory 320 may be at least in part accessible to processor 310. Memory 320 may be means for storing information. Memory 320 may comprise computer instructions that processor 310 is configured to execute. When computer instructions configured to cause processor 310 to perform certain actions are stored in memory 320, and device 300 overall is configured to run under the direction of processor 310 using computer instructions from memory 320, processor 310 and/or its at least one processing core may be considered to be configured to perform said certain actions.

Device 300 may comprise a transmitter 330. Device 300 may comprise a receiver 340. Transmitter 330 and receiver 340 may be configured to transmit and receive, respectively, information in accordance with at least one cellular or non-cellular standard. Transmitter 330 may comprise more than one transmitter. Receiver 340 may comprise more than one receiver. Transmitter 330 and/or receiver 340 may be configured to operate in accordance with Ethernet, Bluetooth and/or universal serial bus, USB, standards, for example.

Device 300 may comprise user interface, UI, 360. UI 360 may comprise at least one of a display, a keyboard, a touchscreen and a mouse. A user may be able to operate device 300 via UI 360, for example to accept configure loudspeakers.

Processor 310 may be furnished with a transmitter arranged to output information from processor 310, via electrical leads internal to device 300, to other devices comprised in device 300. Such a transmitter may comprise a serial bus transmitter arranged to, for example, output information via at least one electrical lead to memory 320 for storage therein. Alternatively to a serial bus, the transmitter may comprise a parallel bus transmitter. Likewise processor 310 may comprise a receiver arranged to receive information in processor 310, via electrical leads internal to device 300, from other devices comprised in device 300. Such a receiver may comprise a serial bus receiver arranged to, for example, receive information via at least one electrical lead from receiver 340 for processing in processor 310. Alternatively to a serial bus, the receiver may comprise a parallel bus receiver.

Device 300 may comprise further devices not illustrated in FIG. 3. In some embodiments, device 300 lacks at least one device described above.

Processor 310, memory 320, transmitter 330, receiver 340, NFC transceiver 350, UI 360 and/or user identity module 370 may be interconnected by electrical leads internal to device 300 in a multitude of different ways. For example, each of the aforementioned devices may be separately connected to a master bus internal to device 300, to allow for the devices to exchange information. However, as the skilled person will appreciate, this is only one example and depending on the embodiment various ways of interconnecting at least two of the aforementioned devices may be selected without departing from the scope of the present invention.

In some embodiments, control device 110 may trigger a calibration of the subwoofer phase, to align phase between the subwoofer and a monitor loudspeaker. In detail, the subwoofer phase may be adjusted to match the phase of the monitor loudspeaker at a frequency where audio playback responsibility shifts from the monitor loudspeaker to the subwoofer.

Control device 110 may be configured to select an optimal monitor loudspeaker for calibration with a subwoofer. For example, the loudspeaker closest to the subwoofer and/or transmitting sound in the same general direction may be selected for this purpose. Control device 110 may trigger a measurement event to enable adjusting the subwoofer phase, wherein the measurement data obtained thereby may be processed using, for example, a maximal cancellation method or a Fourier analysis method.

In a maximal cancellation method, a following sequence of phases may be performed. The test signal in this method may be, for example, a sinusoid at the frequency mentioned above, where playback responsibility shifts to the subwoofer. This is beneficial since phase is unambiguous in a sinusoidal signal.

- a first test signal is fed to the subwoofer and its level is measured
- a second test signal is fed to the monitor loudspeaker and its level is measured
- a level of the first and/or second test signal is adjusted so that the measured levels match
- subsequently, both test signals are activated at the exact same time, causing them to occur at the same phase at the source points of sound
- a resulting sum sound level is measured, and the phase of the subwoofer is adjusted to obtain the minimum sound level of the sum sound
- the phase value obtained in this measurement is then shifted by 180 degrees, being equal to 2 pi radians, and this modified phase value is then taken in use in the subwoofer. In some embodiments, the shift is not precisely 180 degrees, but close enough to 180 degrees to produce a similar result.

In a Fourier analysis method, an impulse response of the multi-loudspeaker system is determined, yielding an estimate of an impulse response of a specific loudspeaker or subwoofer. From this, a complex valued Fourier transform may be obtained, the real and imaginary parts of which enable determination of a phase estimate for each frequency. A calibration method based on this principle may comprise the following sequence of phases:

- a response of each of a set of subwoofers and loudspeakers to a predetermined test signal is measured one by one using a microphone
- an estimate of the impulse response of each subwoofer and loudspeaker is then determined with this data
- the beginning of the impulse response is determined for each subwoofer and loudspeaker. The length of time preceding the beginning comprises various electrical and measurement delays and time-of-flight of sound between emissions and measurement in a microphone
- the starts of impulse responses are synchronized to occur simultaneously by adjusting time delays specific to individual subwoofers and loudspeakers. The delays thus obtained are the corrections that loudspeakers and subwoofers require in order to locate apparently at equal distance from the microphone
- in the case of several microphone locations, one of the positions is selected as the measurement point in this regard (primary position)
- the delays appearing in the starts of the impulse responses corresponding to electronics, computer data processing and the time-of-flight of audio may now be eliminated. This is beneficial as the accuracy of the next phase may thereby be increased.
- the impulse response can now be time-windowed to enable selection of how much the reverberation of the room affects the impulse response estimate at different frequencies
- a Fourier transform of the impulse responses is then obtained, for example by using Fast Fourier Transform, FFT. This is possible since the test signal is present in digital sampled form
- the Fourier transform result is typically a complex-valued sequence, with each value in the sequence having a real and an imaginary part. Based on the ratio of these the phase may be estimated at each frequency present in the Fourier transform by comparing thus obtained phase values it is possible to determine, how much the subwoofer phase needs to be adjusted to set it in phase with the monitor loudspeaker.

In this Fourier method, the test signal is typically a broadband signal having energy on the frequencies where the frequency response is to be measured. Random or pseudorandom noise may be employed. A sinusoid signal having a frequency changing at a certain rate can be designed to contribute maximal energy density at all the measurement frequencies. Such a signal can maximize the signal-to-noise ratio of the measurement. Adjusting the rate of frequency change in such a sinusoid signal enables adjustment of the power density of this signal.

An additional advantage of the Fourier method is that the measured data also enables estimating a joint response of the loudspeaker and subwoofer working together. The Fourier method also enables optimization of the subwoofer phase so that the joint response fulfils a predetermined criterion. An example of such a criterion is that the response over a selected band of operation is as flat as possible.

In some embodiments, the user can view the determined responses by interacting with a user interface element associated with a subwoofer. The user may select a monitor loudspeaker to calibrate with a certain subwoofer by selecting the associated user interface element, for example a monitor icon. The user may then trigger the calibration, for example, by activating a microphone icon on the user interface.

Some embodiments of the invention enable automatic calibration of a response of the multi-loudspeaker system. A room affects a response of a loudspeaker, and a system operating in accordance with at least some embodiments of the present invention enables determination of necessary compensations to the deviations in the frequency response such that distortions in the audible sound are reduced. This process is known as equalization.

Equalization may comprise the following phases:

- after triggering, the system may be configured to wait for a short while to allow the user to leave the room. This wait may comprise a wait of, for example, 5 or 10 seconds
- each subwoofer and loudspeaker present in the system may be instructed to start generating a test signal
- a control device, or an adapter, may be instructed to begin recording measurement data
- a time domain reference signal, or delineation signal, may be injected in the recorder measurement data by the recording device to indicate the start of signal generation
- measurement data arriving from a microphone is recorded and made available to a computer by the control device, for example via a universal serial bus, USB, interface. The computer may be comprised in the control device.
- the control device stores the incoming data before it is transferred to the computer
- during the measurement process, a level of the measured signal may be monitored. The level corresponds to a signal-to-noise ratio of the measurement. In case the level is too low, the subwoofer or loudspeaker may be instructed to increase their output level and/or the sensitivity at the microphone input may be increased at the control device, to obtain a sufficient level in relation to the noise prevalent in the room where the measurement takes place
- this measurement process is repeated for each loudspeaker and subwoofer present in the system and a member of the active group After the measurement event, a computation may be triggered wherein the following phases may be performed:

- based on the recorded measurement data and the pre-known test signal, an impulse response estimate is determined for each subwoofer and loudspeaker in the active group. FFT and inverse FFT, iFFT, transforms may be employed co calculate the impulse response as a ratio in the frequency domain. FFT may be used to transform the time domain signal into frequency domain and iFFT may be used to bring the resulting ratio of the input and output signal transforms back to the time domain
- the technical delay component present in the impulse response estimate is removed. The technical delay component comprises the various delays of the system, and its length may be determined using the delineation signal generated by the adapter device
- windowing may be used to remove measurement delay from the impulse response
- frequency selective windowing may be used to reduce the effect of the room on the impulse response
- a frequency response is determined from the resulting impulse response using a Fourier transform method. The frequency response is a complex valued sequence
- an estimate of sound level at each frequency present in the Fourier transform is determined from the magnitudes of the complex values in the complex valued sequence
- a resulting frequency response may be presented to the user graphically.

After determining the response, the system may trigger a response compensation filter coefficient determination procedure. Room response effects are controlled by filtering that reduces distortion caused by the room. Determining the coefficients for compensation filters may comprise the following phases:

- an optimization method, for example a non-linear optimization method, may be initialized to initial values. Initial values may be based on knowledge of frequencies where the response is largest globally and locally in different frequency bands. Heuristics can be employed to set compensating coefficients to those frequencies
- the optimization may be started. Its purpose is to adjust filter centre frequency, width and amplification so, that best compensation is obtained
- optimization may employ a cost function intended to obtain a significant value when the optimization process is far from the intended target. The target is a response having no significant local level deviations in the passband from either a constant sound level or a monotonically declining sound level. Alternatively, the local deviations in the passband may be minimized relative to another frequency response
- information fed into the optimization is formed so that wideband phenomena receive larger weight. The purpose of doing this is that the human ear is more sensitive to perceiving the coloration of a wideband level deviation relative to a constant or monotonically changing sound pressure level, compared to a narrowband deviation
- this cost function is then used to drive optimization until a sufficiently low value of the cost function is obtained
- at this point, the resulting filter coefficients are recorded into a data file and transmitted to the respective loudspeakers and subwoofers where they are applied into filters.

In addition to the equalizer filter coefficients, the time delay that passes from the transmission of the audio signal to the beginning of the impulse response is known. This time delay reflects the time-of-flight from the subwoofer or loudspeaker to the microphone. When the time-of-flight for each device is measured, the delays may be adjusted so that the time-of-flights for each loudspeaker and subwoofer appear the same. To enable this delay compensation, each loudspeaker and subwoofer contains an adjustable delay component. The user interface, or another function in the control device, may automatically adjust the delays in each loudspeaker and subwoofer.

The filter coefficients thus determined may be observed and/or adjusted via the user interface by interacting with a user interface element associated with the respective loudspeaker or subwoofer. When observing the coefficients, the loudspeakers and subwoofers may be presented graphically to the user. The user may be enabled to observe coefficients of more than one loudspeaker at a time, such that more than one filter settings presentation window is open at a time.

In a view displaying properties of an individual loudspeaker or subwoofer, an option may be presented to the user to trigger a measurement process for an individual loudspeaker or subwoofer, or a group of them. This enables checking a single loudspeaker or a group of loudspeakers and subwoofers. This also enables the measurement of the combined response of a group of loudspeakers and/or subwoofers, enabling observation of their joint response. This may enable calibrating a subwoofer, by control device 110, to function together as a system with a main loudspeaker not connected to the control device 110.

Figure 4:
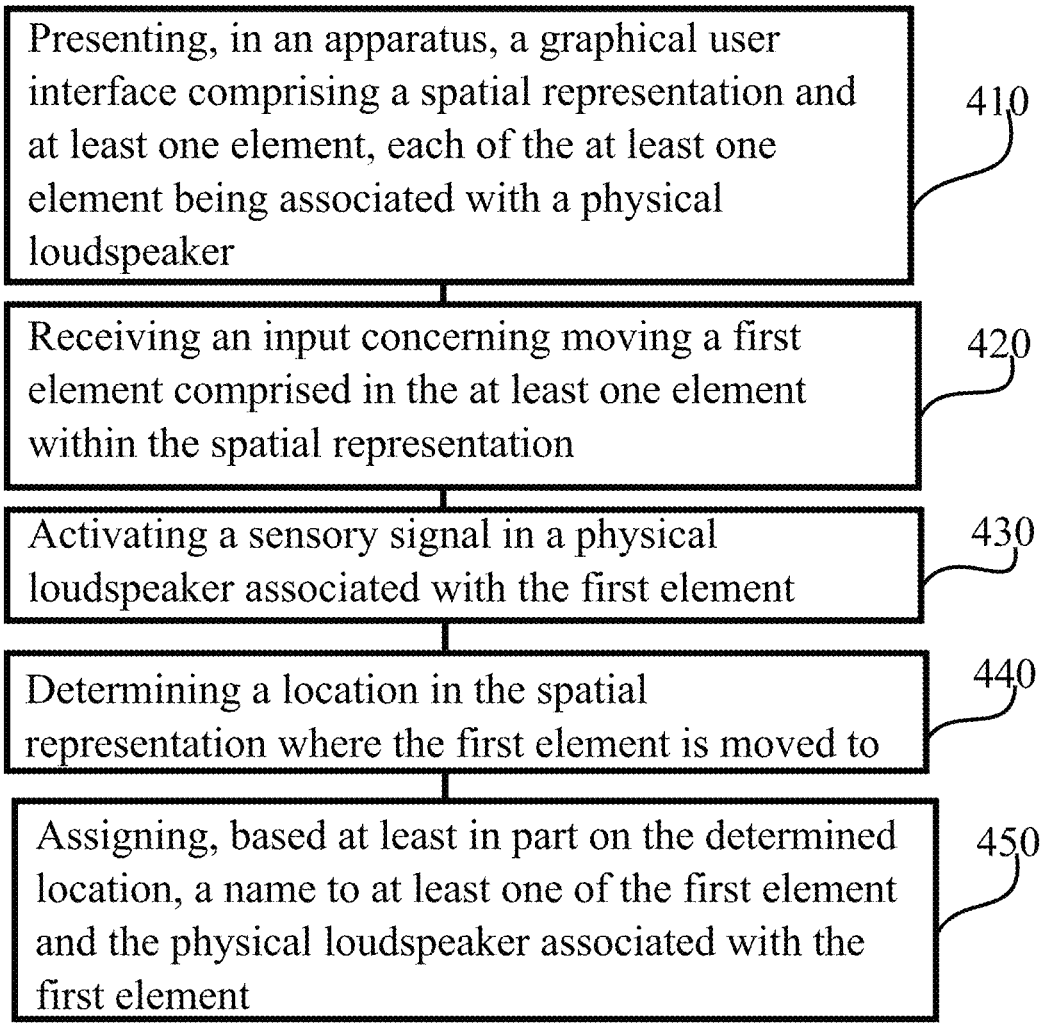
FIG. 4 illustrates signalling in accordance with at least some embodiments of the present invention.

FIG. 4 is a first flow chart of a first method in accordance with at least some embodiments of the present invention. The phases of the illustrated method may be performed in control device 110, for example, or control device 110 may at least in part cause the phases to be performed.

Phase 410 comprises presenting, in an apparatus, a graphical user interface comprising a spatial representation and at least one element, each of the at least element being associated with a specific physical loudspeaker. Phase 420 comprises receiving an input concerning moving a first element comprised in the at least one element within the spatial representation. Phase 430 comprises activating a sensory signal in a physical loudspeaker associated with the first element. The sensory signal may be caused to be emitted during a time when a user is moving the first element in the spatial representation. Phase 440 comprises determining a location in the spatial representation where the first element is moved to. This determining may comprise determining the location where the user leaves the first element, or a location where the user drags the first element to. Finally, phase 450 comprises assigning, based at least in part on the determined location, a name to at least one of the first element and the physical loudspeaker associated with the first element.

Figure 5:
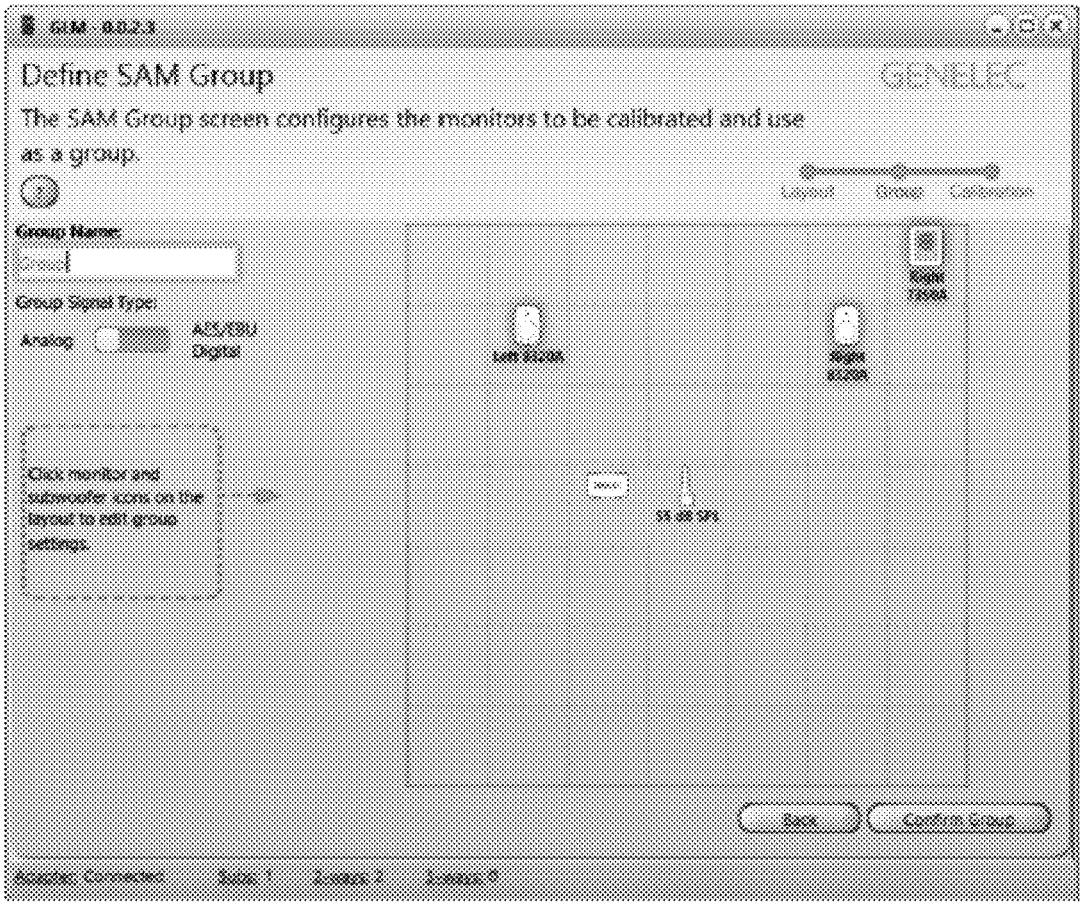
FIG. 5 is an example view of a user interface in accordance with at least some embodiments of the present invention.

FIG. 5 is an example view of a user interface in accordance with at least some embodiments of the present invention. In the example of FIG. 5, a user interface is being used by a user to define a group of loudspeakers, wherein a group of loudspeakers may comprise a subset of loudspeakers connected in the multi-loudspeaker system. A group of loudspeakers may be assigned a name, for example by providing a text input field to the user, as illustrated in FIG. 5.

Further to a name, a group may be associated with a signal type, which may be selectable from a list comprising an analogue signal and a digital signal, such as for example an AES/EBU signal.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the following description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

The invention claimed is:

1. An apparatus comprising at least one processing core and at least one memory including computer program code, the at least one memory and the computer program code being configured to, with the at least one processing core, cause the apparatus at least to:

present a graphical user interface displaying a spatial representation and at least two elements associated with specific physical loudspeakers, receive an input concerning moving a first element comprised in the at least two elements within the spatial representation, cause activation of a sensory signal in a physical loudspeaker associated with the first element, determine a location in the spatial representation where the first element is moved to, and assign, based at least in part on the determined location and on a type of physical loudspeaker associated with the first element, a name to at least one of the first element and the physical loudspeaker associated with the first element, wherein the type of physical loudspeaker is received in the apparatus directly from the loudspeaker without user involvement, and display the name on the graphical user interface, wherein the name contains indications of the location and the type of physical loudspeaker.

2. The apparatus according to claim 1, wherein the at least one memory and the computer program code are configured to, with the at least one processing core, cause the apparatus to, based at least in part on the determined location, assign an audio channel to the physical loudspeaker associated with the first element.

3. The apparatus according to claim 1, wherein, the at least two elements are associated with physical loudspeakers of different types.

4. The apparatus according to claim 3, wherein the different types comprise a monitor loudspeaker and a subwoofer.

5. The apparatus according to claim 1, wherein the at least one memory and the computer program code are configured to, with the at least one processing core, cause the apparatus to assign the name based at least in part on whether the determined location is in a central part, a left-hand-side part or a right-hand-side part of the spatial representation.

6. The apparatus according to claim 1, wherein the graphical user interface comprises a functionality configured to, when activated, trigger a calibration procedure.

7. The apparatus according to claim 1, wherein the graphical user interface is configured to convey information relating to a status of at least one physical loudspeaker associated with an element comprised in the graphical user interface.

8. The apparatus according to claim 1, wherein the graphical user interface comprises at least two spatial representations, each of the at least two spatial representations being associated with a vertical level of a room.

9. The apparatus according to claim 8, wherein the at least one memory and the computer program code are configured to, with the at least one processing core, cause the apparatus to conceal at least one spatial representation that is not in use from view, while a user interacts with another spatial representation.

10. The apparatus according to claim 1, wherein the at least one memory and the computer program code are configured to, with the at least one processing core, cause the apparatus to select, based at least in part on the determined location, a digital audio subframe for the physical loudspeaker associated with the first element.

11. The apparatus according to claim 4, wherein the at least one memory and the computer program code are configured to, with the at least one processing core, cause the apparatus to associate one monitor loudspeaker with one subwoofer, the monitor loudspeaker and the subwoofer each being associated with exactly one of the at least two elements.

12. The apparatus according to claim 11, wherein the at least one memory and the computer program code are configured to, with the at least one processing core, cause the apparatus to cause calibration of a phase of the subwoofer associated with the monitor loudspeaker, with the monitor loudspeaker.

13. The apparatus according to claim 1, wherein the at least one memory and the computer program code are configured to, with the at least one processing core, cause the apparatus to determine an impulse response of a room associated with the spatial representation, and to determine, based at least in part on the impulse response, equalization information concerning the room.

14. The apparatus according to claim 13, wherein the graphical user interface comprises functionality configured to, when activated, enable a user to at least one of view and modify equalization information concerning a specific physical loudspeaker.

15. A method, comprising:

presenting, in an apparatus, a graphical user interface displaying a spatial representation and at least one element, associated with a specific physical loudspeaker;

receiving an input concerning moving a first element comprised in the at least one element within the spatial representation;

causing activation of a sensory signal in a physical loudspeaker associated with the first element;

determining a location in the spatial representation where the first element is moved to, assigning, based at least in part on the determined location and on a type of physical loudspeaker associated with the first element, a name to at least one of the first element and the physical loudspeaker associated with the first element wherein the type of physical loudspeaker is received in the apparatus directly from the loudspeaker without user involvement, displaying the name on the graphical user interface, wherein the name contains indications of the location and the type of the physical loudspeaker.

16. The method according to claim 15, further comprising causing the apparatus to, based at least in part on the determined location, assign an audio channel to the physical loudspeaker associated with the first element.

17. The method according to claim 15, wherein the sensory signal comprises at least one of a sound or a light signal.

18. The method according to claim 15, wherein the spatial representation models, at least in part, a system layout of a loudspeaker system.

19. The method according to claim 15, wherein the at least one element comprises at least two elements, the at least two elements being associated with physical loudspeakers of different types.

20. The method according to claim 15, comprising causing the apparatus to assign the name based at least in part on whether the determined location is in a central part, a left-hand-side part or a right-hand-side part of the spatial representation.

21. The method according to claim 15, wherein the graphical user interface comprises a functionality configured to, when activated, trigger a calibration procedure of at least one of sound colour, timing and volume.

22. The method according to claim 15, wherein the graphical user interface is configured to convey information relating to a status of at least one physical loudspeaker associated with an element comprised in the graphical user interface.

23. The method according to claim 15, wherein the graphical user interface comprises at least two spatial representations, each of the at least two spatial representations being associated with a vertical level of a room.

24. The method according to claim 23, comprising causing the apparatus to conceal at least one spatial representation that is not in use from view, while a user interacts with another spatial representation.

25. The method according to claim 15, comprising causing the apparatus to select, based at least in part on the determined location, a digital audio subframe for the physical loudspeaker associated with the first element.

26. The method according to claim 15, comprising causing the apparatus to associate one monitor loudspeaker with one subwoofer, the monitor loudspeaker and the subwoofer each being associated with exactly one of the at least two elements.

27. The method according to claim 26, comprising causing the apparatus to calibrate a phase of the subwoofer associated with the monitor loudspeaker, with the monitor loudspeaker.

28. The method according to claim 27, wherein the calibrating comprises using at least one of a maximal cancellation method or a Fourier analysis method.

29. The method according to claim 15, comprising causing the apparatus to determine an impulse response of a room associated with the spatial representation, and to determine, based at least in part on the impulse response, equalization information concerning the room.

30. The method according to claim 29, wherein the graphical user interface comprises functionality configured to, when activated, enable a user to at least one of view and modify equalization information concerning a specific physical loudspeaker.

31. A non-transitory computer readable medium having stored thereon a set of computer readable instructions that, when executed by at least one processor, cause an apparatus to at least:

present, in an apparatus, a graphical user interface displaying a spatial representation and at least one element, associated with a specific physical loudspeaker;

receive an input concerning moving a first element comprised in the at least one element within the spatial representation;

cause activation of a sensory signal in a physical loudspeaker associated with the first element;

determine a location in the spatial representation where the first element is moved to, and assign, based at least in part on the determined location and on a type of physical loudspeaker associated with the first element, a name to at least one of the first element and the physical loudspeaker associated with the first element, wherein the type of physical loudspeaker is received in the apparatus directly from the loudspeaker without user involvement, and display the name on the graphical user interface, wherein the name contains indications of the location and the type of the physical loudspeaker.

* * * * *